United States Patent [19]

Heinemann et al.

[11] Patent Number: 4,896,837

[45] Date of Patent: Jan. 30, 1990

[54] ROLLER MILL

[75] Inventors: Otto Heinemann, Ennigerloh; Norbert Bredenhöller, Oelde, both of Fed. Rep. of Germany

[73] Assignee: Krupp Polysius AG, Fed. Rep. of Germany

[21] Appl. No.: 281,660

[22] Filed: Dec. 9, 1988

[30] Foreign Application Priority Data

Jan. 21, 1988 [DE] Fed. Rep. of Germany ..... 3801728

[51] Int. Cl.[4] ..... B02C 15/04; B02C 15/10

[52] U.S. Cl. ..... 241/121; 241/285 A

[58] Field of Search ..... 241/117-121, 241/285 R, 285 A, 285 B

[56] References Cited

U.S. PATENT DOCUMENTS

| | | | |
|---|---|---|---|
| 2,698,142 | 12/1954 | Crites et al. | 241/121 X |
| 4,485,974 | 12/1984 | Cass | 241/121 X |
| 4,717,082 | 1/1988 | Guido et al. | 241/121 |

*Primary Examiner*—Timothy V. Eley

*Attorney, Agent, or Firm*—Learman & McCulloch

[57] ABSTRACT

This invention relates to a roller mill in which the shafts of the grinding rollers are mounted in two self-aligning roller bearings of which one forms a fixed bearing and the other is constructed as a vertically movable floating bearing. Such a roller mill is distinguished by a standard design which is economical to produce and can be equipped with a variable number of grinding rollers.

10 Claims, 10 Drawing Sheets

ROLLER MILL

The invention relates to a roller mill including a new and improved form of grinding roller mounting wherein the roller shaft is supported in a pair of respectively fixed and vertically movable bearings.

Background of the Invention

In the previously known roller mills of the type, the shafts of the grinding rollers are mounted by means of radial bearings in arms which are pivotable about horizontal axes within the mill housing so that the grinding rollers are capable of sprung vertical movement with respect to the grinding plate.

The principal disadvantage of these known constructions is that a quite different design is necessary depending upon the number of grinding rollers required.

The object of the invention, therefore, is to construct a roller mill in such a way that a particularly simple and largely standardized design is achieved which can be equipped with a variable number of grinding rollers.

According to the invention the shafts of the grinding rollers are each mounted in two self-aligning roller bearings of which one bearing as a fixed bearing forms a point of rotation whilst the other bearing is constructed as a vertically movable floating bearing. Thus according to the invention the bearings have a dual function: On the one hand they form a pure rotary mounting for the grinding roller shafts. On the other hand they form a rotary and tilt mounting for the grinding roller shafts to produce a vertical movement of the grinding rollers for the purpose of pressing onto the grinding plate.

By this construction a minimum cost standard design is achieved which can be varied according to the number of grinding rollers and assembled into a grinding system so that a wide range of capacity can be covered with one standard design.

The two bearings of the individual grinding roller shafts are advantageously arranged outside the mill housing, which facilitates a more far-reaching standardization of the mill housing (irrespective of the number of grinding rollers required).

The Drawings

Some embodiments of the invention are illustrated in the drawings, in which.

Detailed Description

Figure 1:
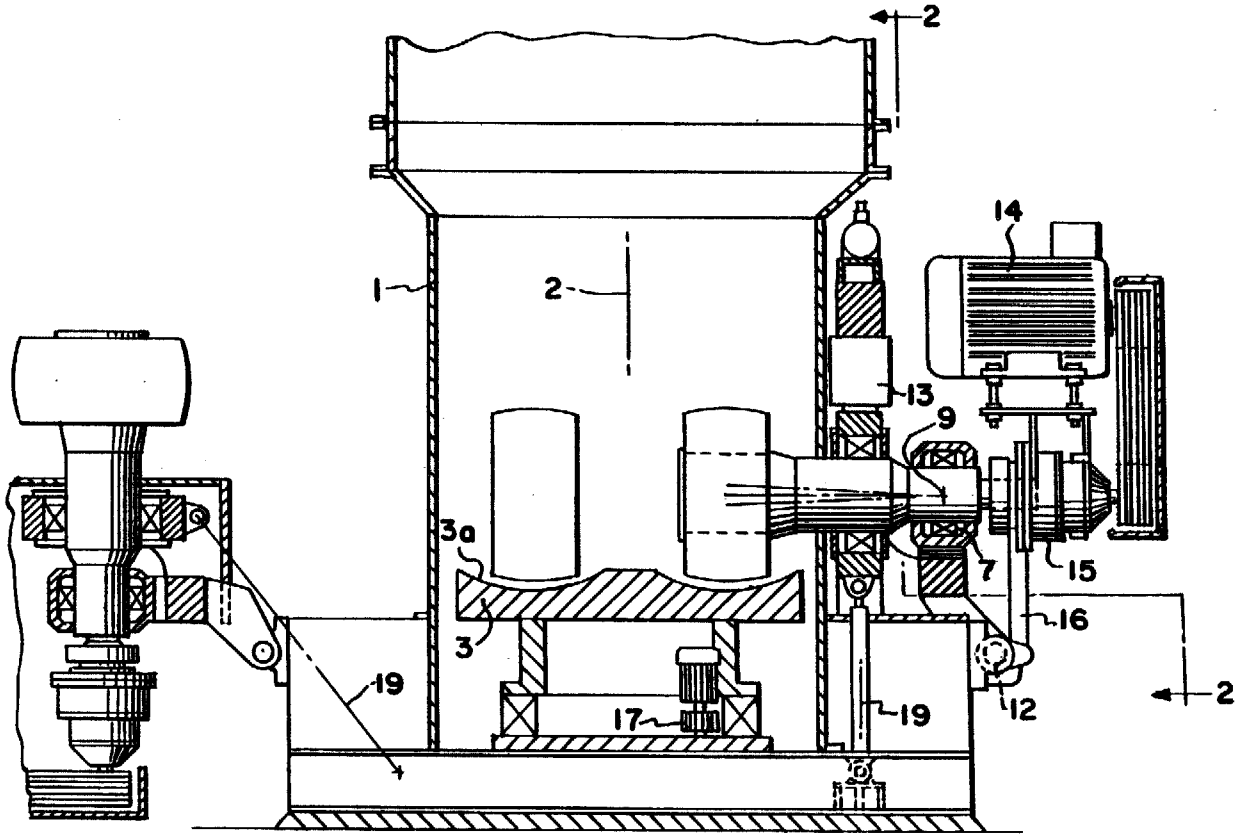
FIG. 1 shows a vertical section through a first embodiment of the roller mill according to the invention.
Figure 2:
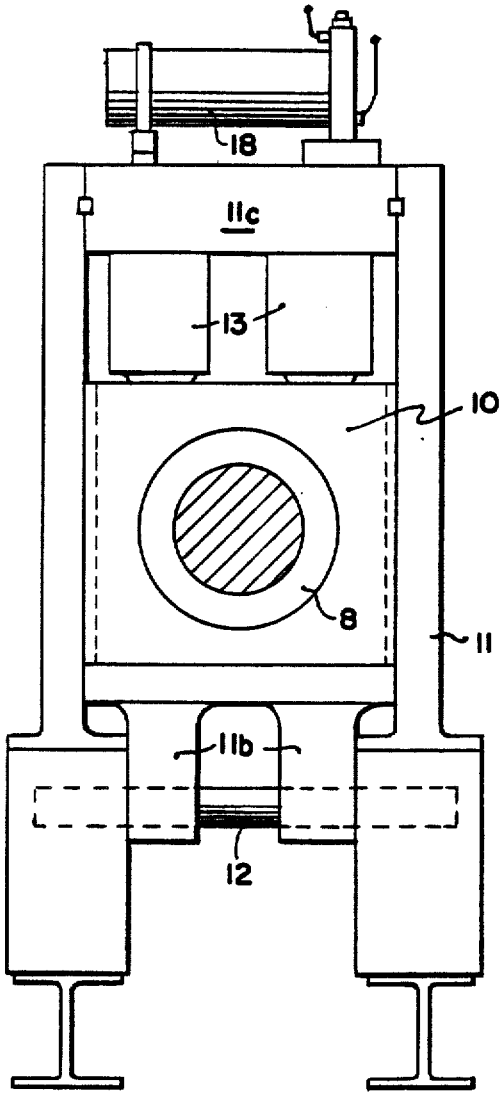
FIG. 2 shows a section along the line II—II in FIG. 1.

The roller mill illustrated in FIGS. 1 to 4 contains a mill housing 1 with a vertical axis 2. In the mill housing 1 a grinding plate 3 is mounted so as to be rotatable about the housing axis 2 and contains a circular ring-shaped grinding track 3*a* on which the grinding rollers 4 roll.

The grinding rollers 4 are rotatable about their axis 5 and are set on a grinding roller shaft 6 which is mounted in two bearings 7, 8.

The two bearings 7, 8 are constructed as self-aligning roller bearings, so that the grinding roller shaft 6 can carry out a tilting movement in addition to pure rotary movement in these bearings 7, 8.

The bearing 7 is constructed as a fixed bearing. Its center constitutes a point of rotation for the grinding roller shaft 6.

By contrast the bearing 8 is constructed as a vertically movable floating bearing. For this purpose it is arranged in a bearing jewel 10 which is vertically movable in a slide frame 11. The shape of the slide frame 11 can be seen in particular from FIGS. 2–4: The lower part 11*a* of the slide frame 11 is bent outwards at right angles, supports the housing of the fixed bearing and is provided with two lugs 11*b* by means of which the slide frame 11 is pivotably mounted on a shaft 12 which is arranged lower than the fixed bearing 7.

Figure 3:
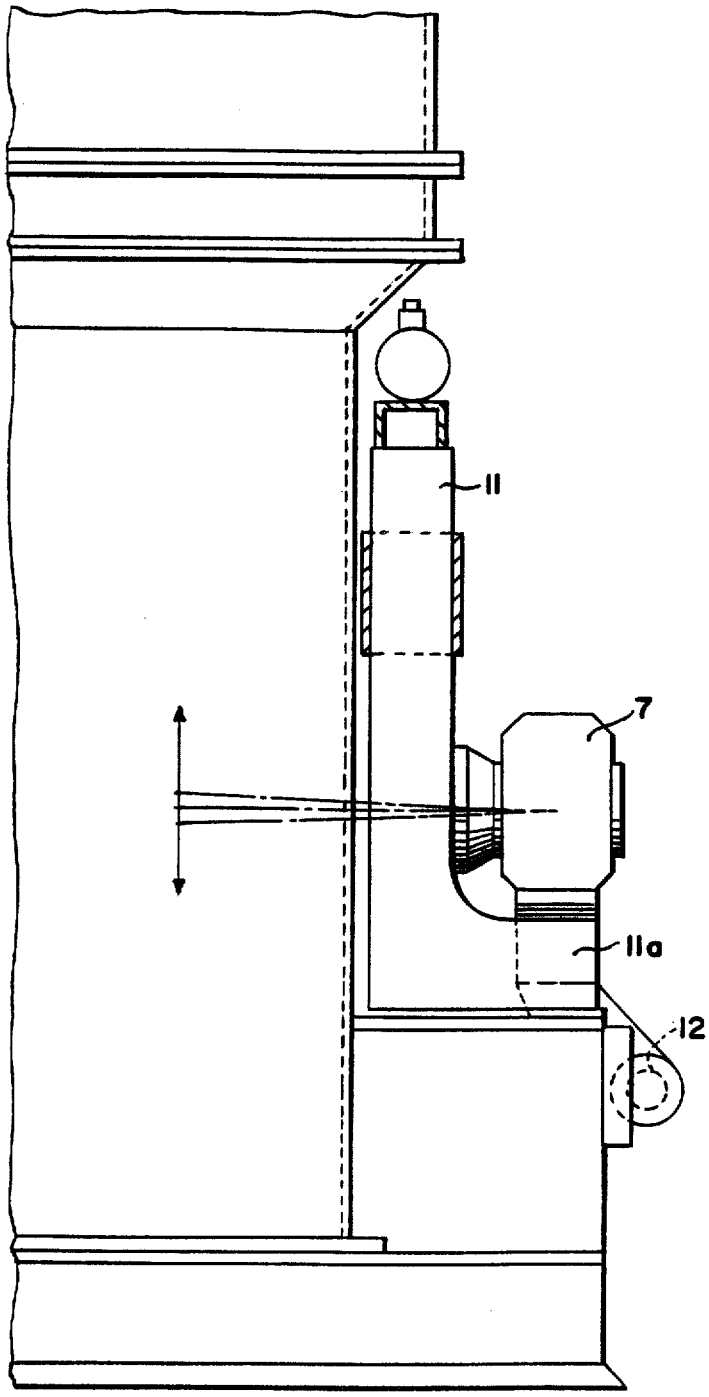
FIG. 3 shows a partial side view which shows the construction of the slide frame for the bearing jewel of the floating bearing.
Figure 4:
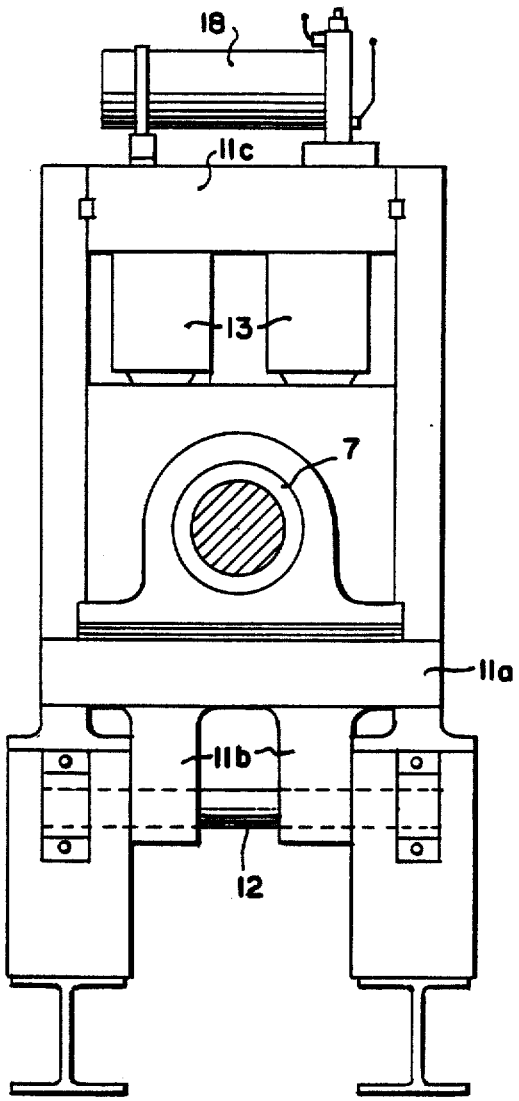
FIG. 4 shows a view in the direction of the arrow X of FIG. 3.

As FIGS. 1 and 3 show in particular, the two bearings 7, 8 are arranged outside the mill housing 1.

Hydropneumatic springs 13 which press the bearing jewel 10 downwards in the slide frame 11 are arranged between the bearing jewel 10 which supports the floating bearing 8 and the upper crosspiece 11*c* of the slide frame 11.

The individual grinding rollers 6 are driven in each case by a motor 14 via a slip-on gear unit 15, and a torque support 16 is provided to take up the moment of rotation. In the embodiment according to FIGS. 1 to 4 the grinding plate 3 is provided with an additional auxiliary drive 17.

The assembly consisting of the grinding roller 4, the grinding roller shaft 6, the bearings 7, 8, the bearing jewel 10, the slide frame 11, the hydropneumatic springs 13, a store 18 for the springs 13, the drive motor 14 and the slip-on gear unit 15 can be swivelled out as an entity from the mill housing 1. For this purpose a hydraulic lifting arrangement 19 engages on the lower end of the bearing jewel 10 and when it is actuated the aforesaid grinding roller assembly is swivelled about the axis 12. In FIG. 1 the left-hand grinding roller assembly is illustrated in the swivelled-out position.

The hydraulic lifting arrangement 19 can be used at the same time to adjust the floating bearing 8 in a vertical direction, as it forms a stop which limits the tilting movement of the grinding rollers 4 in the direction of the grinding plate 3. Because the bearings 7 and 8 are constructed as self-aligning roller bearings the grinding roller shaft 6 and thus with it the grinding roller 4 in operation can carry out a tilting movement in the vertical direction (about the point of rotation formed by the center point 9 of the fixed bearing 7) in addition to its purely rotary movement, and the hydropneumatic springs 13 produce the elastic restoring forces.

Figure 5:
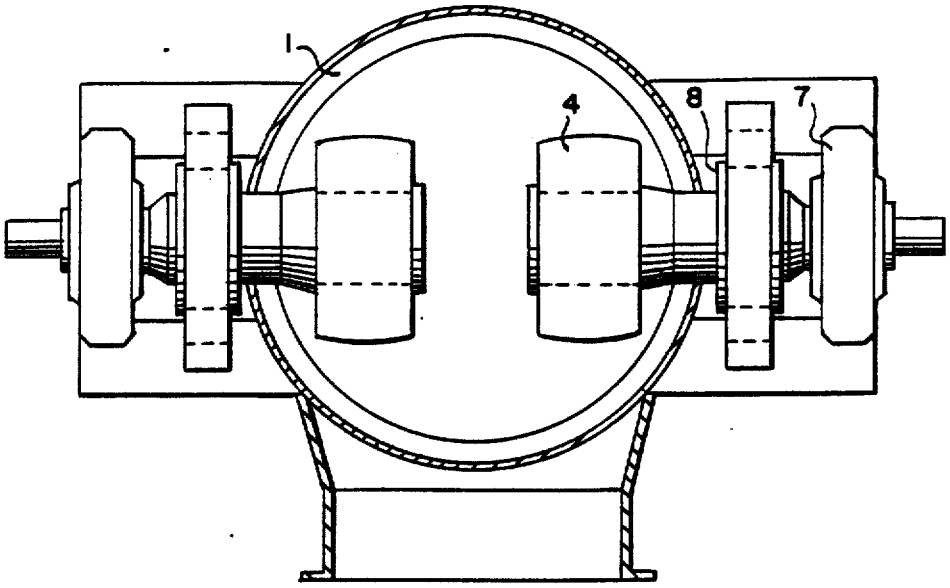
FIGS. 5, 6 and 7 show plan views of three embodiments of the roller mill according to the invention equipped with a variable number of grinding rollers.
Figure 6:
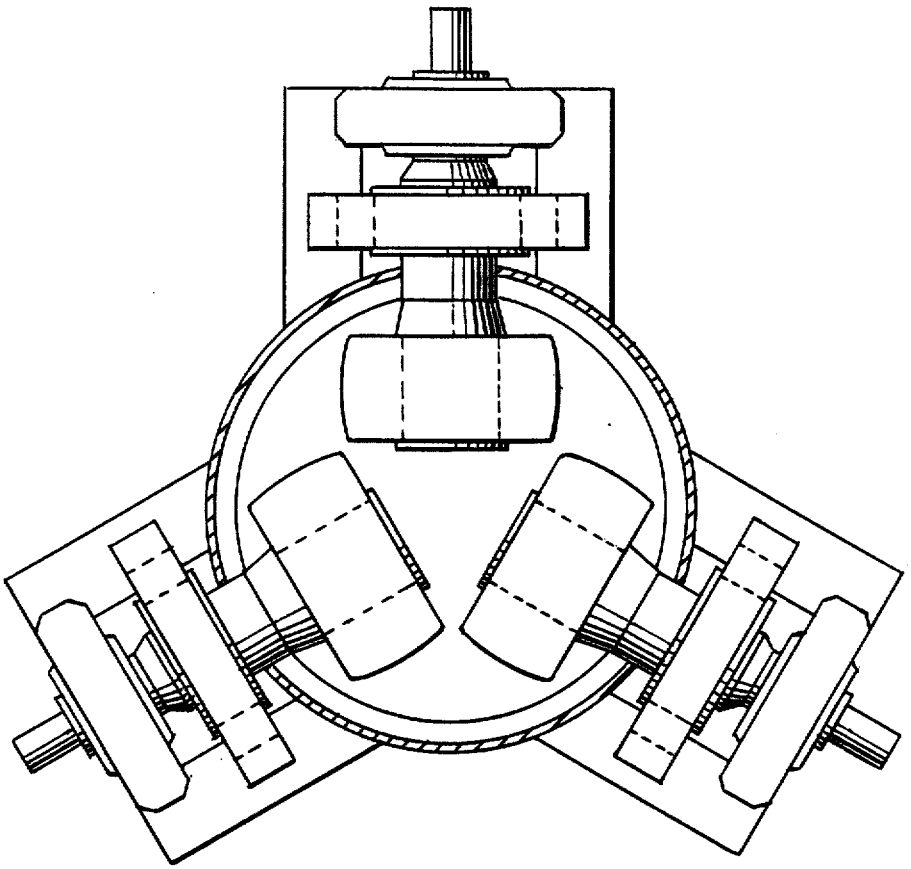
Figure 7:
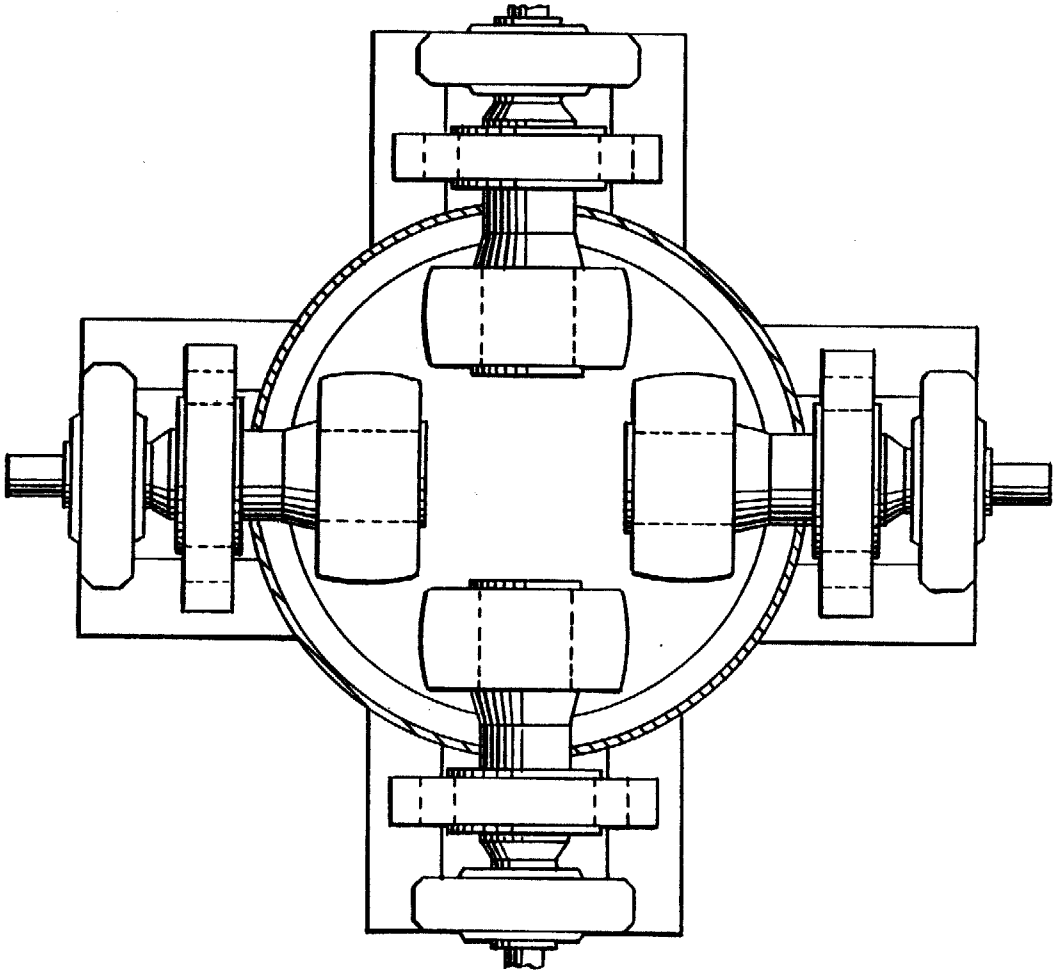

In FIGS. 5 to 7 it is shown how the roller mill according to FIGS. 1 to 4 can be equipped with a variable number of grinding rollers (two, three or four) whilst maintaining the standard design of the housing and the individual grinding roller assemblies.

Figure 8:
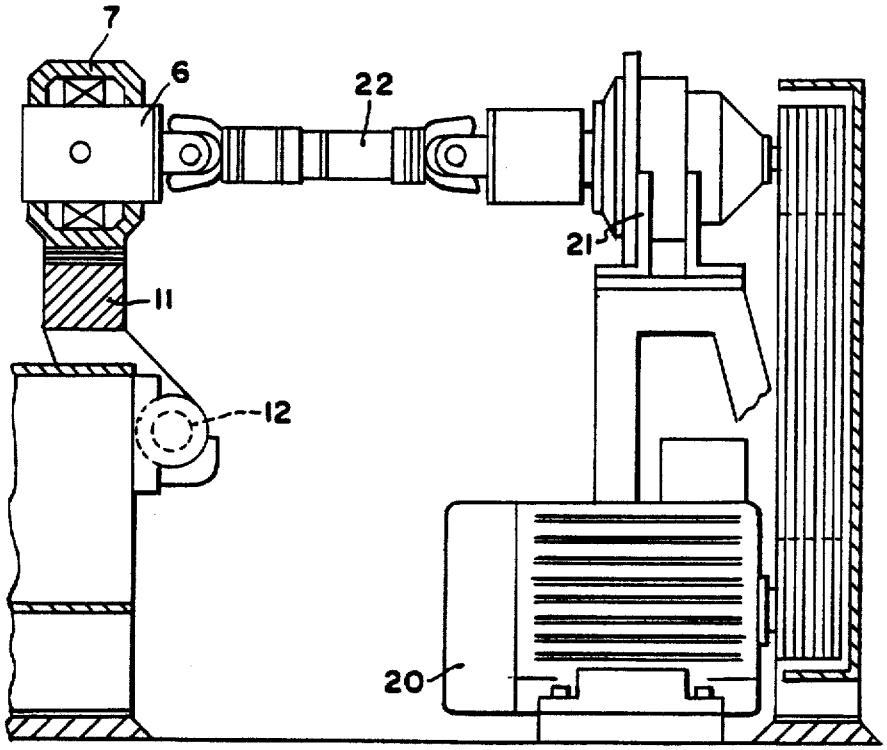
FIG. 8 shows a detail of a further embodiment.

In the embodiment according to FIG. 8 the individual grinding roller shafts are driven by a stationary motor 20 and a gear unit 21 via a drive shaft 22. If the grinding roller assembly is to be swivelled outwards about the axis 12 in the manner already described, then first of all the drive shaft 22 which connects the gear unit 21 to the grinding roller shaft 6 is removed.

Figure 9:
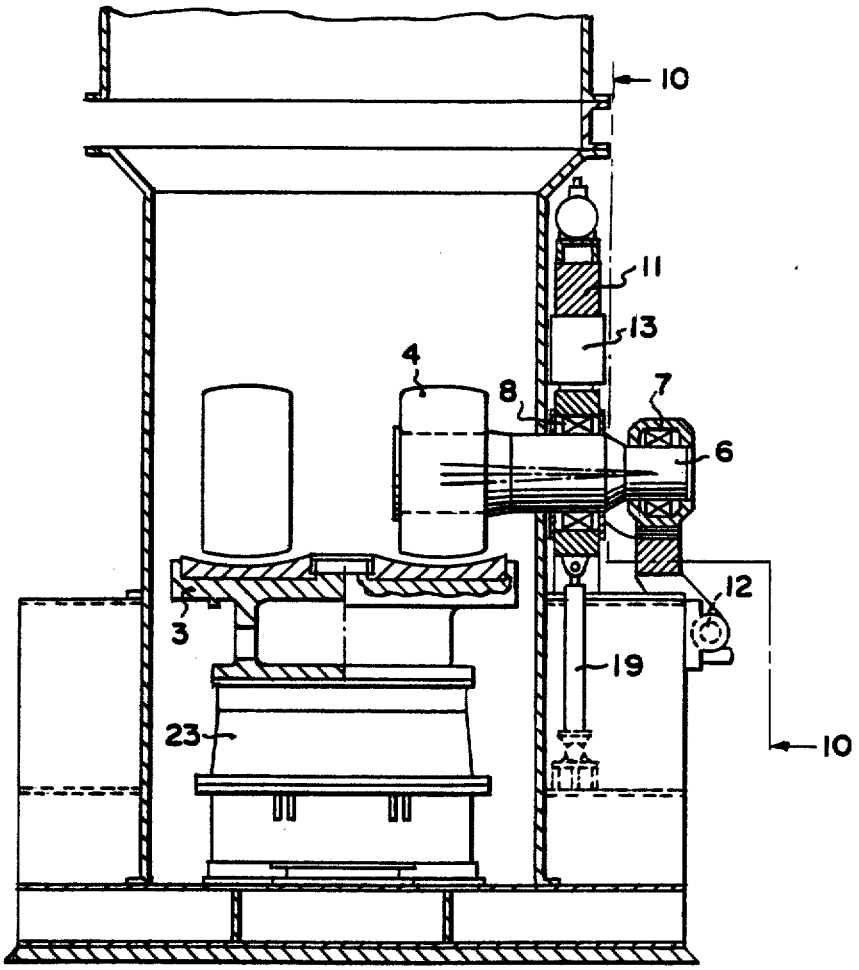
FIG. 9 shows a section (according to FIG. 1) through a further embodiment.
Figure 10:
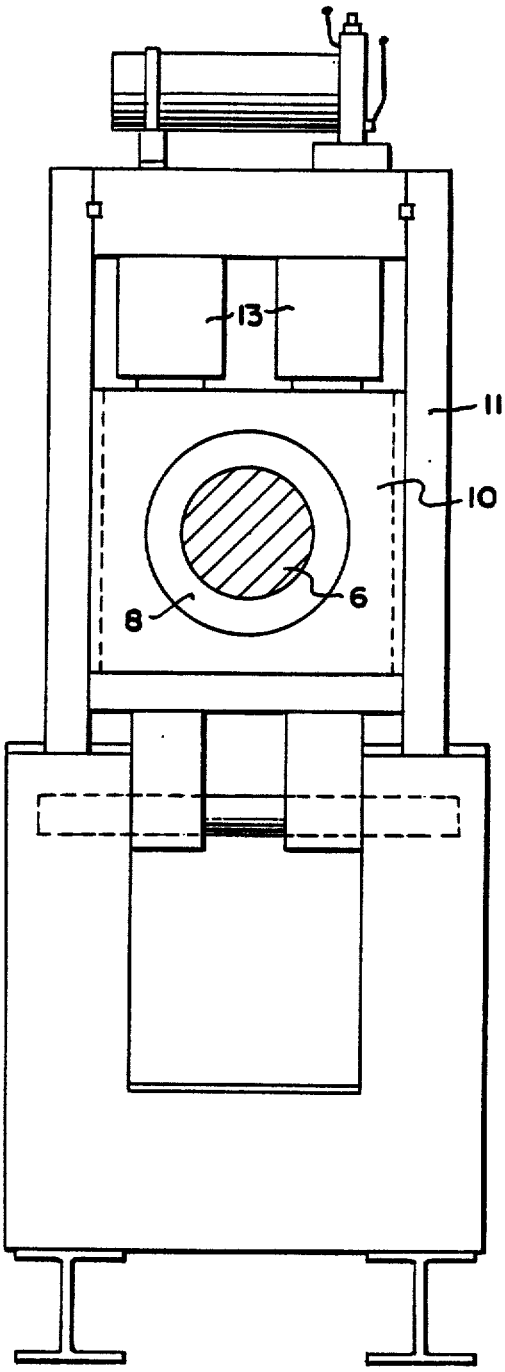
FIG. 10 shows a section along the line X—X in FIG. 9.

In the embodiment according to FIGS. 9 and 10 the grinding rollers 4 with their grinding roller shafts 6 are loosely mounted so as to be rotatable in the bearings 7, 8, i.e. they are not driven. The grinding plate 3 is provided with a drive arrangement 23 (with gear unit).

Otherwise the construction of the mounting of the grinding roller shafts 6 corresponds to the previously described embodiment.

What is claimed is:

1. A roller mill comprising a housing, a grinding plate in said housing, drive means for rotating said grinding plate, a grinding roller overlying said grinding plate for cooperative grinding action therewith, a rotatable shaft forming a part of said roller and having an end portion projecting therefrom, first bearing means engaging said shaft end portion and establishing an axis of rotation which is fixed vertically relative to said grinding plate, second bearing means engaging said shaft end portion, and adjusting means engaging said second bearing means for permitting vertical movement thereof relative to said grinding plate, whereby said second bearing means functions as a floating bearing, each of said first and second bearing means being self-aligning bearings.

2. The roller mill of claim 1 wherein said second bearing means occupies a position between said first bearing means and said roller.

3. The roller mill of claim 1 wherein said bearing means are located outside said housing.

4. The roller mill of claim 1 wherein said second bearing means is positioned within a bearing jewel, and slide frame means mounting said jewel for vertical movement therein.

5. The roller mill of claim 4 wherein said slide frame means includes hydropneumatic spring means arranged to press against said bearing jewel in a vertically downward direction relative to said grinding plate.

6. The roller mill of claim 5 wherein said first bearing means is supported by said slide frame, and pivot means pivotally mounting said slide frame on said housing, whereby said roller, shaft, both of said bearing means, said bearing jewel, said slide frame and said spring means may be pivoted away from said grinding plate relative to said housing.

7. The roller mill of claim 6 wherein said bearing means are located outside said housing.

8. The roller mill of claim 6 including lift means engaging said bearing jewel to provide adjustment for said floating bearing and pivoting of said slide frame about said pivot means.

9. The roller mill of claim 1 wherein said drive means engage said shaft end portion at said first bearing means.

10. The roller mill of claim 9 wherein said drive means includes a slip-on gear unit and torque support means.

* * * * *